US007818898B1

(12) United States Patent
Orengo

(10) Patent No.: US 7,818,898 B1
(45) Date of Patent: Oct. 26, 2010

(54) ORNAMENTAL SHOE

(76) Inventor: Angel S. Orengo, 284 Bright St., Jersey City, NJ (US) 07302

( * ) Notice: Subject to any disclaimer, the term of this patent is extended or adjusted under 35 U.S.C. 154(b) by 600 days.

(21) Appl. No.: 11/860,752

(22) Filed: Sep. 25, 2007

(51) Int. Cl.
*A43B 23/00* (2006.01)
*A43B 23/17* (2006.01)
*A43B 1/06* (2006.01)

(52) U.S. Cl. ..... 36/45; 36/25 R; 36/9 A; 36/87

(58) Field of Classification Search ..... 36/45, 36/25 R, 84, 86, 87, 9 A
See application file for complete search history.

(56) References Cited

U.S. PATENT DOCUMENTS 1,730,768 A * 10/1929 Heyman ..... 87/8
1,751,557 A * 3/1930 Roberts ..... 36/35 R
1,773,681 A * 8/1930 Johnson ..... 36/45
1,879,144 A * 9/1932 Emery ..... 36/3 A
1,968,012 A * 7/1934 Boghosian ..... 36/12
RE21,392 E * 3/1940 Hurwit ..... 36/3 A
2,495,045 A * 1/1950 Woodbury et al. ..... 36/44
5,606,807 A * 3/1997 Prepodnik ..... 36/8.1

* cited by examiner

*Primary Examiner*—Ted Kavanaugh

(57) ABSTRACT

An ornamental shoe which is constructed of an upper shoe portion and a lower shoe portion, wherein the upper shoe portion includes a body portion, a tongue and a heel portion; while the lower shoe portion includes a sole portion; wherein the upper and lower shoe portions are woven of strips of material selected from the group consisting of cardboard and transparent plastic film of different color sewn together by nylon threads.

5 Claims, 2 Drawing Sheets

ORNAMENTAL SHOE

FIELD OF THE INVENTION

The present invention generally relates to a novelty gift article and more particularly, relates to an ornamental shoe that can be fabricated by simple household materials.

BACKGROUND OF THE INVENTION

Gift items are frequently necessary for a wide variety of occasions including weddings, birthdays, baby showers, etc. While purchasing a commercially available gift item is always doable, it would be more meaningful if a person can create a personalized gift from a craft kit for the occasion. For instance, a gift item that would adorn various areas within a kitchen, dining room, bedroom, etc. to possible remind the individual of the special occasion.

It is therefore an object of the present invention to provide a special gift item that can be simply fabricated by using household materials.

It is another object of the present invention to provide an ornamental shoe that can be used as a gift for a variety of occasions.

It is a further object of the present invention to provide an ornamental shoe that can be easily fabricated by strips of cardboard, transparent plastic sheet and nylon threads.

SUMMARY OF THE INVENTION

In accordance with the present invention, an ornamental shoe that can be easily fabricated by using household materials is provided.

In a preferred embodiment, the present invention ornamental shoe is constructed of an upper shoe portion including a body portion, a tongue portion and a heel portion; and a lower shoe portion that includes a sole portion; wherein the upper and lower shoe portions are formed of strips of material selected from the group consisting of cardboard and transparent plastic film of different colors sewn together by nylon threads.

BRIEF DESCRIPTION OF THE DRAWINGS

The invention will now be described, by way of example, with reference to the accompanying drawings, in which.

DETAILED DESCRIPTION OF THE PREFERRED EMBODIMENT

The present invention discloses an ornamental shoe that can easily fabricated by using household materials.

The present invention ornamental shoe is a craft kit that enables an individual to create an ornate decoration that would be a perfect gift or favor for a wide array of occasions including weddings or baby showers. The completed craft provides a decoration that could adorn various areas within the kitchen, dining room, bedroom, etc. to possibly remind the individual of the special occasion.

The present invention ornamental shoe consists of a craft kit that forms an ornate shoe that may be produced in a plethora of colors as well as different sizes. The shoe resembles a standard or athletic shoe, can be produces with or without laces. Included within the kit is a thin section of cardboard, quantity of transparent plastic strips and a length of nylon threads. In using the present invention craft kit to fabricate the ornamental shoe, a person completes the ornamental shoe by folding and weaving the plastic strips. The nylon thread can be employed to secure sections of the shoe together. When completed, the person would have a novel shoe that may provide a decoration or the perfect favor for a baby or bra dial shower. The completed shoe can be produced in a variety of sizes and colors.

The present invention ornamental shoe fulfills the need for a craft kit that can produce an ornate decoration. The appealing features of the ornamental shoe are its ease of completion, entertainment value, and the beauty of the completed project. It consists of a craft kit that produces a colorful shoe that may provide the perfect present or a favor for a shower. The decorative item is available in a multitude of colors and features a woven design that garners a great deal of attention and would be a conversation piece.

Figure 1:
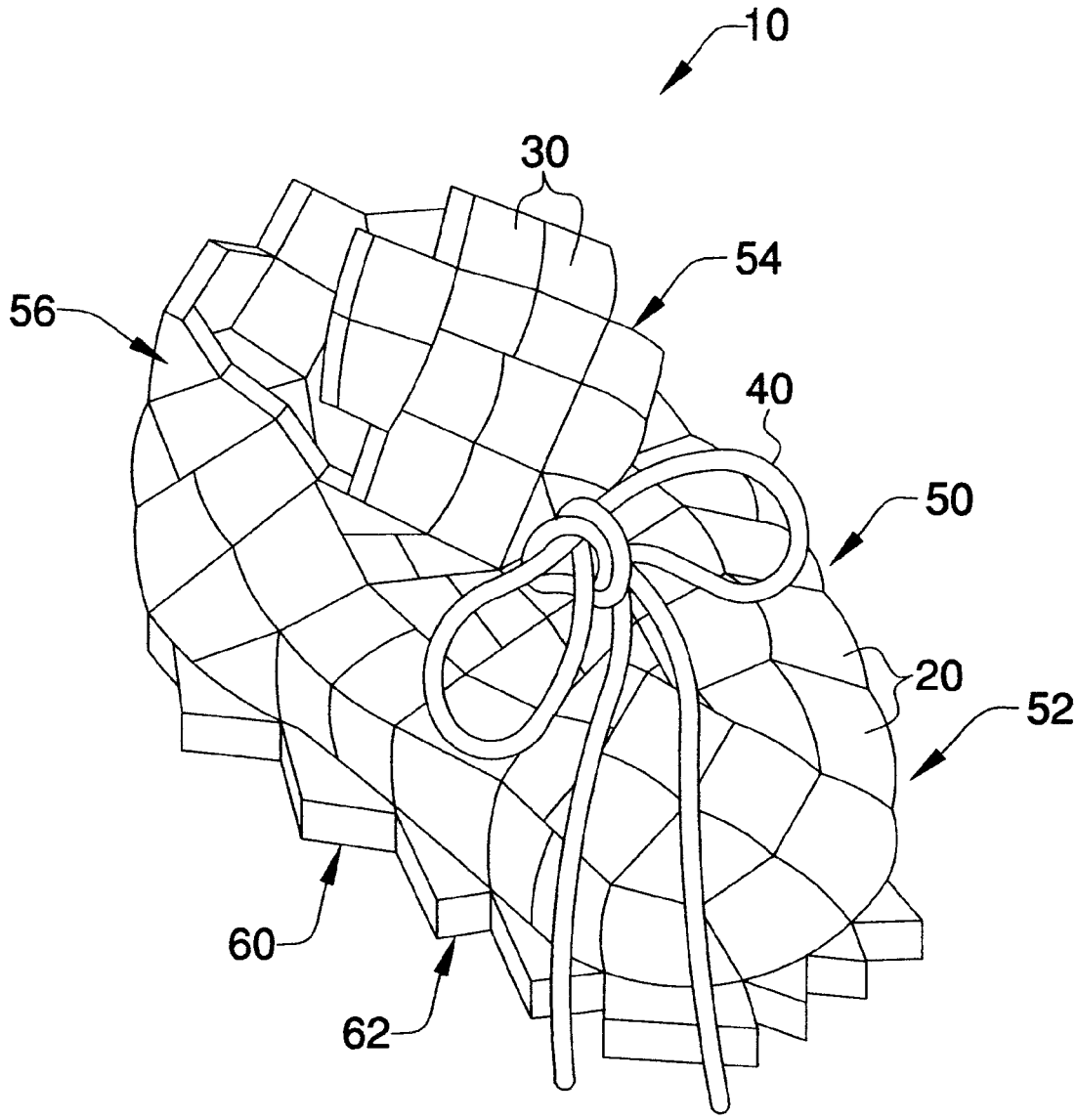
FIG. 1 is a perspective view of the present invention ornamental shoe.

Referring initially to FIG. 1, wherein a perspective view of a present invention ornamental shoe 10 formed by woven strips of materials such as cardboard pieces 20 and transparent plastic film 30 is shown. The ornamental shoe 10 is further provided with laces 40 on top of the shoe. The ornamental shoe 10 is constructed of an upper shoe portion 50 and a lower shoe portion 60. The upper shoe portion including a body portion 52, a tongue portion 54 and a heel portion 56.

The lower shoe portion includes a sole portion 62. The upper and lower shoe portions 50, 60 are formed by weaving strips 70, 80, shown in FIG. 2, together and then fixing the pieces in position by using nylon threads (not shown). The strips of material 70,80 may be suitably formed of thin cardboard of various colors, or thin transparent plastic film of various colors depending on the specific design the user desired.

Figure 2:
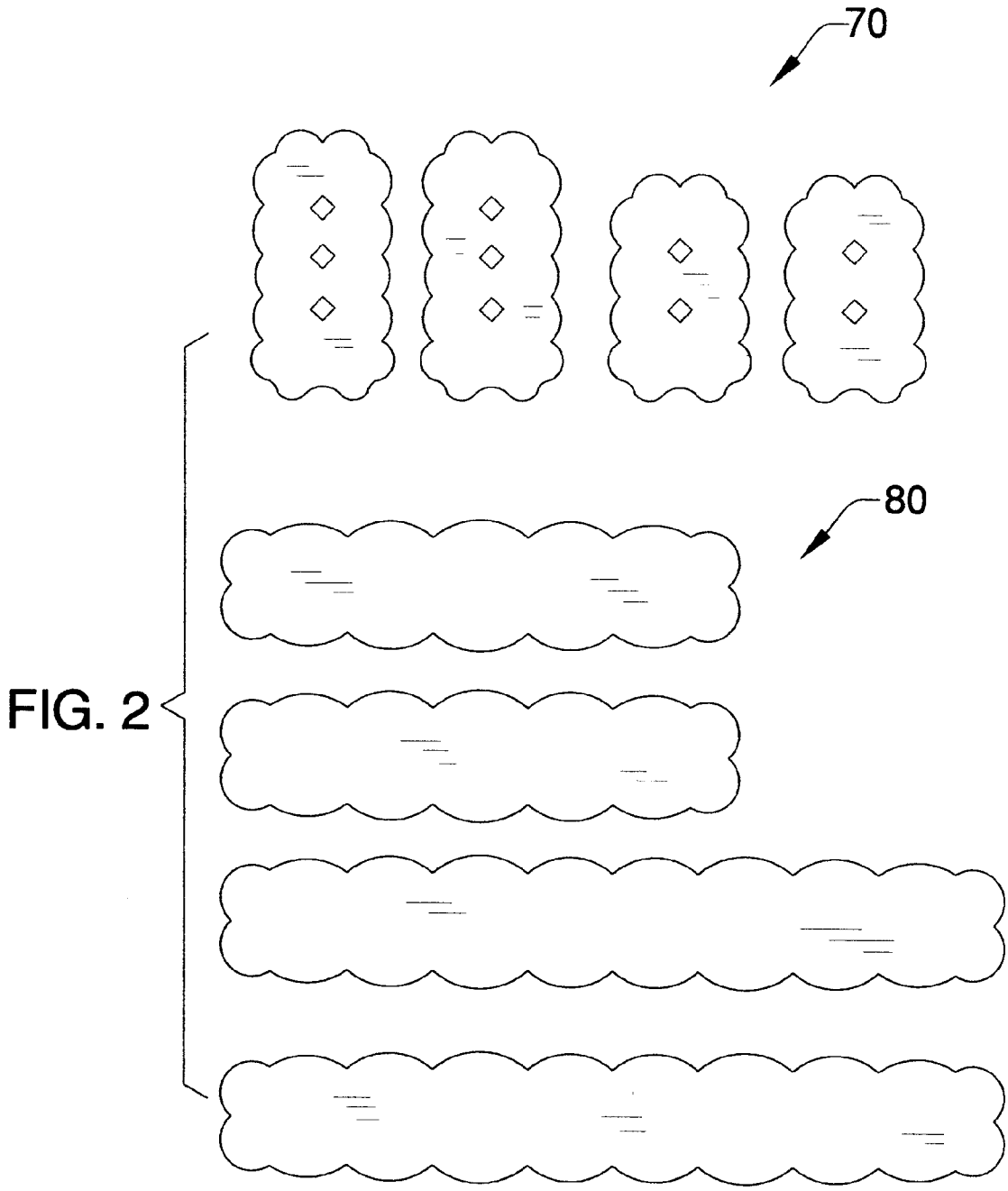
FIG. 2 is an illustration of strips of materials used in the present invention ornamental shoe.

The present invention ornamental shoe has therefore been amply described in the above descriptions and in the appended drawings of FIGS. 1 and 2.

While the preferred embodiments of the invention have been described above, it will be recognized and understood that various modifications can be made in the invention and the appended claims are intended to cover all such modifications which may fall within the spirit and scope of the invention.

What is claimed is:

1. An ornamental shoe comprising:

an upper shoe portion comprises a body portion, a tongue portion and a heel portion; and a lower shoe portion comprises a sole portion;

wherein said upper and lower shoe portions are woven of strips of materials selected from the group consisting of cardboard and transparent plastic film of different colors sewn together by nylon threads.

2. The ornamental shoe according to claim 1 further comprising shoelaces.

3. The ornamental shoe according to claim 1 further comprising shoelaces positioned on top of the body portion of the upper shoe portion.

4. The ornamental shoe according to claim 1 further comprising shoelaces attached by mechanical means to the body portion of the upper shoe portion.

5. The ornamental shoe according to claim 1 further comprising shoelaces attached by glue to the body portion of the upper shoe portion.

* * * * *